US007107876B1

(12) United States Patent
Chen

(10) Patent No.: US 7,107,876 B1
(45) Date of Patent: Sep. 19, 2006

(54) RATCHET TYPE SCREWDRIVER

(76) Inventor: Chyn Huei Chen, No. 22, Lane 427, Dasheng St., Taichung City (TW)

( * ) Notice: Subject to any disclaimer, the term of this patent is extended or adjusted under 35 U.S.C. 154(b) by 105 days.

(21) Appl. No.: 10/759,950

(22) Filed: Jan. 16, 2004

(51) Int. Cl.
*B25B 13/46* (2006.01)

(52) U.S. Cl. ..... 81/58.4; 81/63.1; 192/43.2

(58) Field of Classification Search ..... 81/58.4, 81/59.1, 60–63.2; 192/43.1, 43.2
See application file for complete search history.

(56) References Cited

U.S. PATENT DOCUMENTS 5,379,873 A * 1/1995 Shiao ..... 192/43
6,260,446 B1 * 7/2001 Hu ..... 81/62
6,644,147 B1 * 11/2003 Huang ..... 81/62
6,658,970 B1 * 12/2003 Shiao ..... 81/62

* cited by examiner

*Primary Examiner*—Hadi Shakeri

(57) ABSTRACT

A screwdriver includes a body, a ratchet wheel, two pawl members, two elastic members, a cover, and a catch plate. Thus, the cover can be removed from the body, so that the user can inspect and adjust connection between the pawl members and the ratchet wheel, thereby facilitating the user repairing the screwdriver. In addition, the catch plate stops movement of the ratchet wheel and the pawl members, thereby preventing the ratchet wheel, the pawl members and the elastic members from detaching from the body after the cover is removed from the body.

3 Claims, 19 Drawing Sheets

RATCHET TYPE SCREWDRIVER

BACKGROUND OF THE INVENTION

1. Field of the Invention

The present invention relates to a screwdriver, and more particularly to a ratchet type screwdriver, wherein the user can view the inside of the screwdriver to inspect and adjust connection between the pawl members and the ratchet wheel, thereby facilitating the user repairing the screwdriver.

2. Description of the Related Art

A conventional screwdriver in accordance with the prior art shown in FIG. 19 comprises a body 90, a ratchet wheel 91 mounted on the body 90 and having an outer wall formed with a toothed portion 910, two pawl members 92 each pivotally mounted in the body 90 and each a first face formed with a toothed portion 920 engaged with the toothed portion 910 of the ratchet wheel 91, and two elastic members 93 each urged between a second face of a respective one of the pawl members 92 and the body 90.

However, each of the pawl members 92 has a first side toothed portion A' and a second side toothed portion B' with a greater height differential H', so that the second side toothed portion B' of each of the pawl members 92 has a smaller thickness. Thus, each of the pawl members 92 cannot withstand a larger torque to drive the ratchet wheel 91 to rotate, so that the pawl members 92 are easily worn out at the second side toothed portion B'.

SUMMARY OF THE INVENTION

The primary objective of the present invention is to provide a screwdriver, wherein the cover can be removed from the body, so that the user can inspect and adjust connection between the pawl members and the ratchet wheel, thereby facilitating the user repairing the screwdriver.

Another objective of the present invention is to provide a screwdriver, wherein the catch plate stops movement of the ratchet wheel and the pawl members, thereby preventing the ratchet wheel, the pawl members and the elastic members from detaching from the body after the cover is removed from the body.

A further objective of the present invention is to provide a screwdriver, wherein each of the pawl members can withstand a larger torque to drive the ratchet wheel to rotate.

In accordance with the present invention, there is provided a screwdriver, comprising a body, a ratchet wheel, two pawl members, two elastic members, a cover, and a catch plate, wherein:

the body has a first end formed with a receiving hole and a plurality of receiving recesses each communicating with the receiving hole, the first end of the body is formed with a positioning slit;

the ratchet wheel is mounted on the body and has an outer wall formed with an annular toothed portion mounted in the receiving hole of the body;

each of the pawl members is mounted in a respective one of the receiving recesses and has a first face formed with a toothed portion engaged with the toothed portion of the ratchet wheel, each of the pawl members has an end formed with a driven block;

each of the elastic members is urged between a side face of a respective one of the receiving recesses of the body and a respective one of the pawl members;

the cover is rotatably mounted on the body and has a closed end formed with a depression formed with a protruding urging block having two urging sides each of which is movable with the cover to press the driven block of a respective one of the pawl members; and the catch plate is mounted in the positioning slit of the body to catch the ratchet wheel and the pawl members, thereby preventing the ratchet wheel, the pawl members and the elastic members from detaching from the body.

Further benefits and advantages of the present invention will become apparent after a careful reading of the detailed description with appropriate reference to the accompanying drawings.

DETAILED DESCRIPTION OF THE INVENTION

Figure 1:
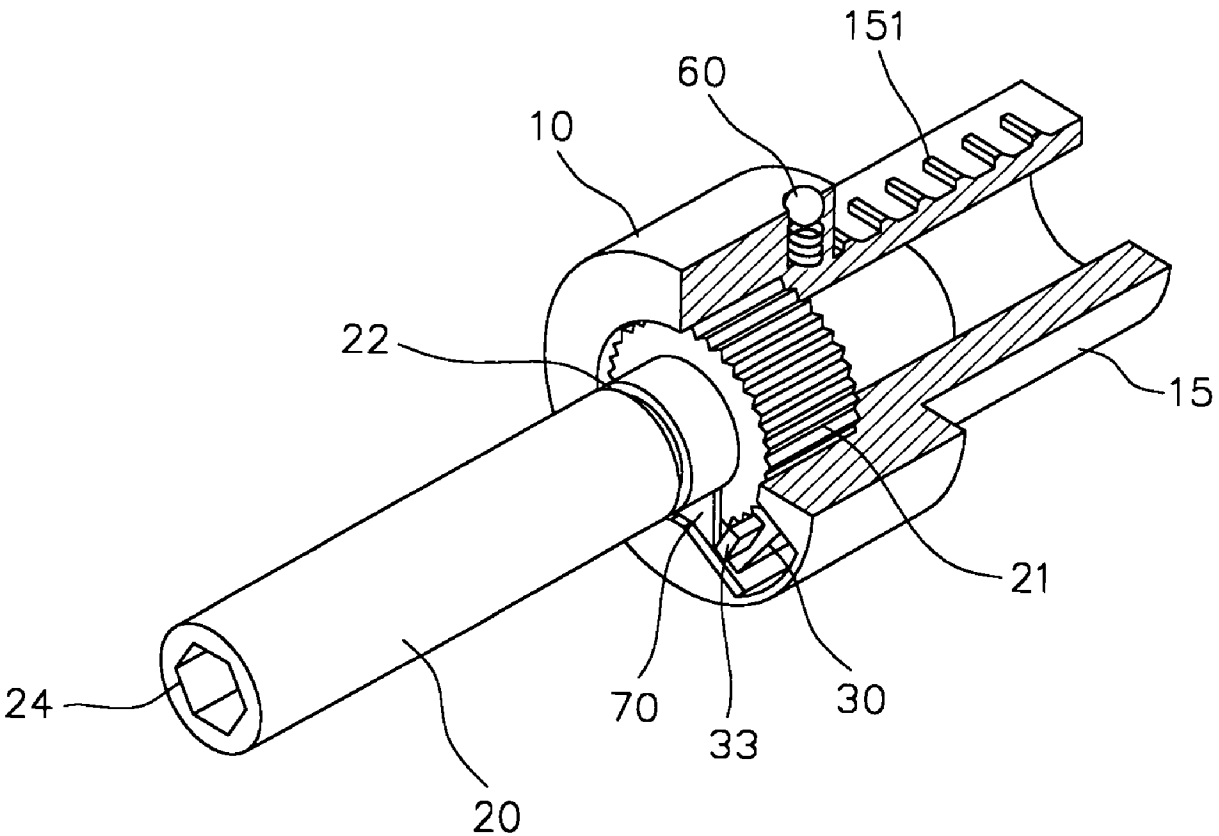
FIG. 1 is a partially cross-sectional perspective view of a screwdriver in accordance with the preferred embodiment of the present invention.
Figure 2:
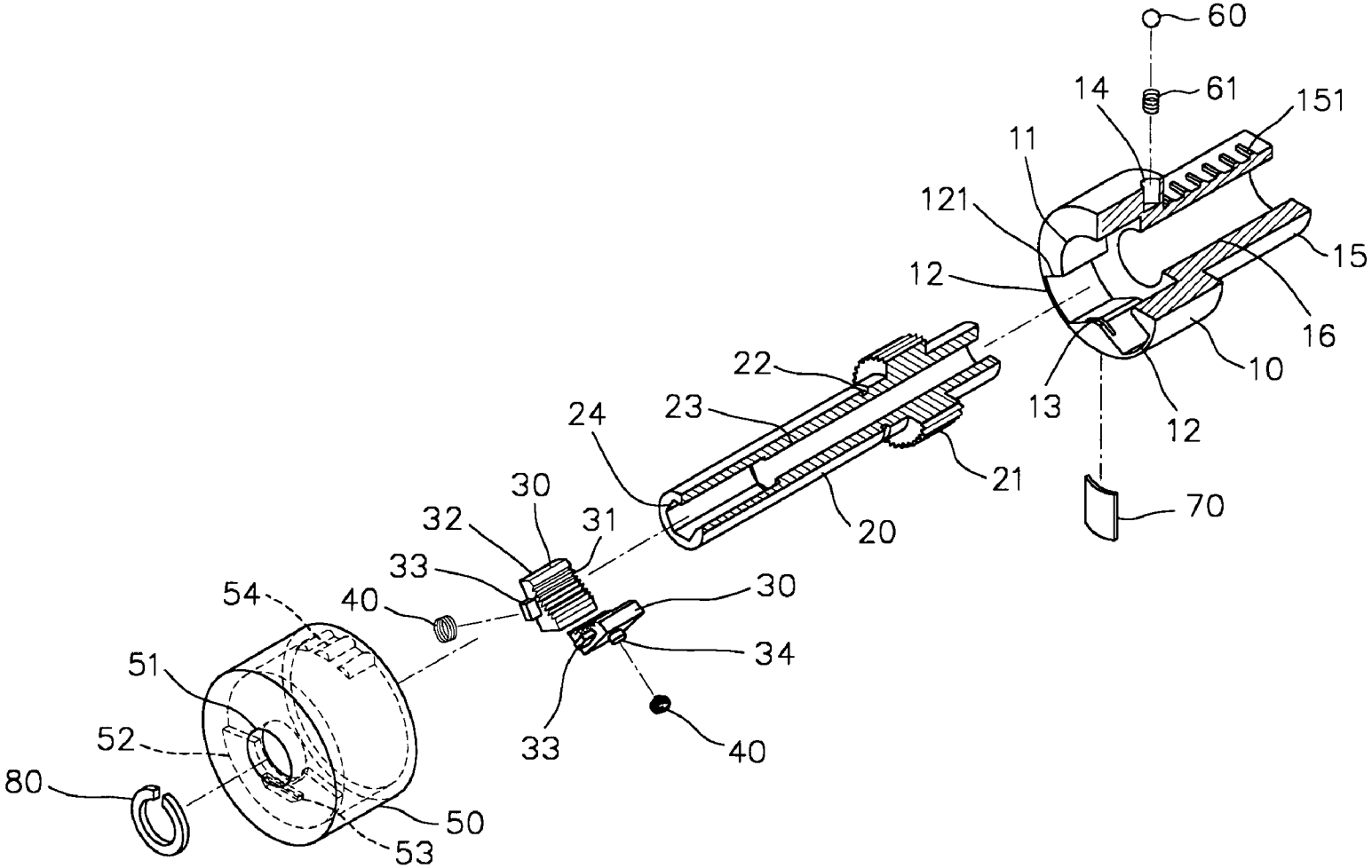
FIG. 2 is an exploded perspective view of the screwdriver in accordance with the preferred embodiment of the present invention.
Figure 3:
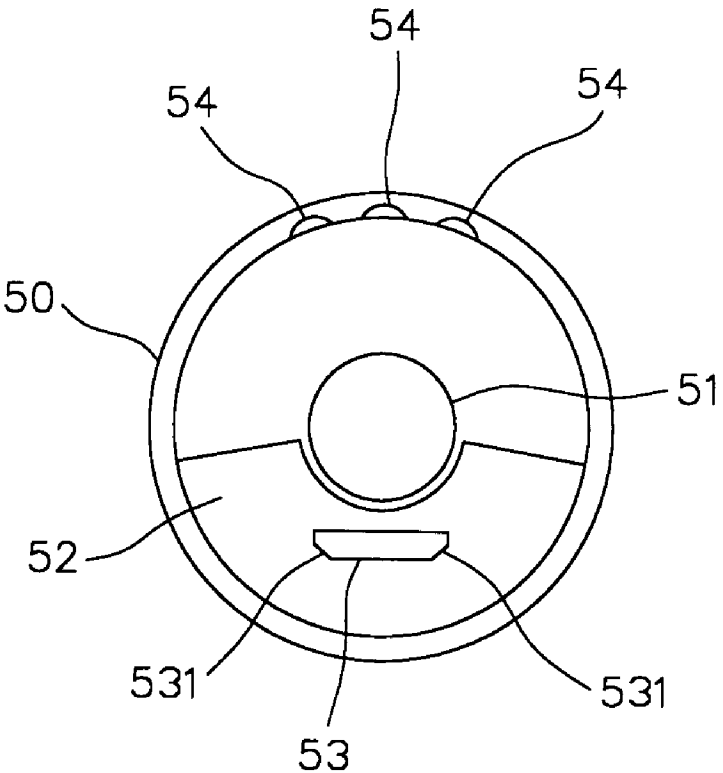
FIG. 3 is a plan view of a cover of the screwdriver as shown in FIG. 2.
Figure 4:
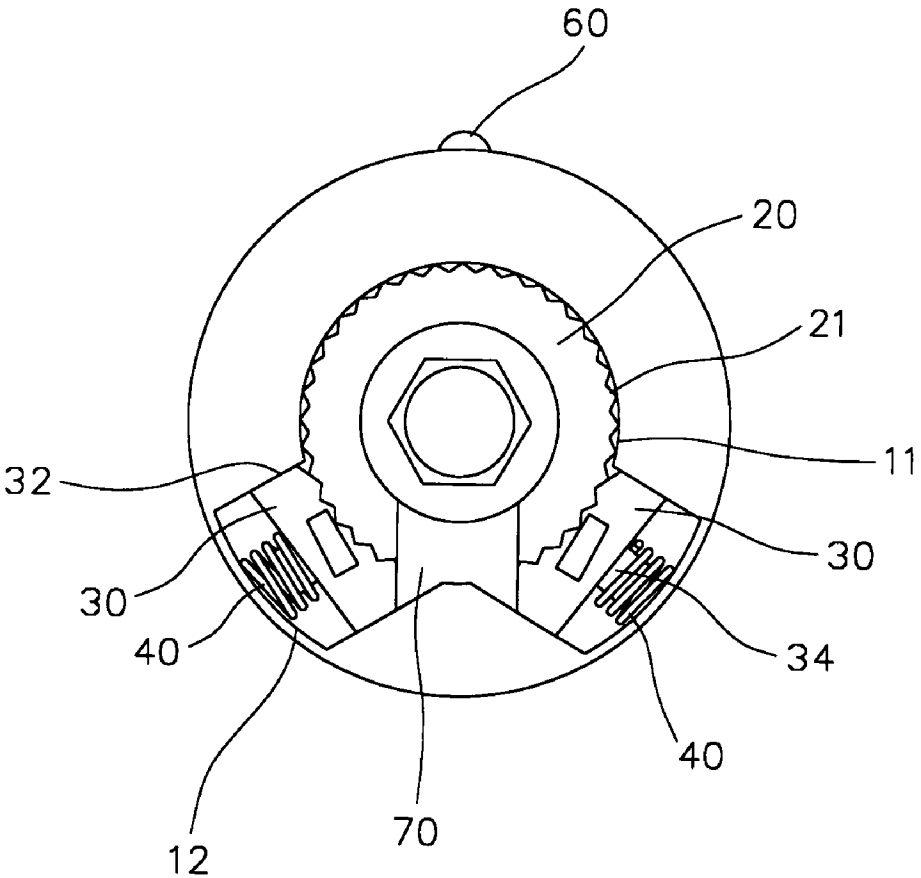
FIG. 4 is a plan view of the screwdriver as shown in FIG. 1.
Figure 5:
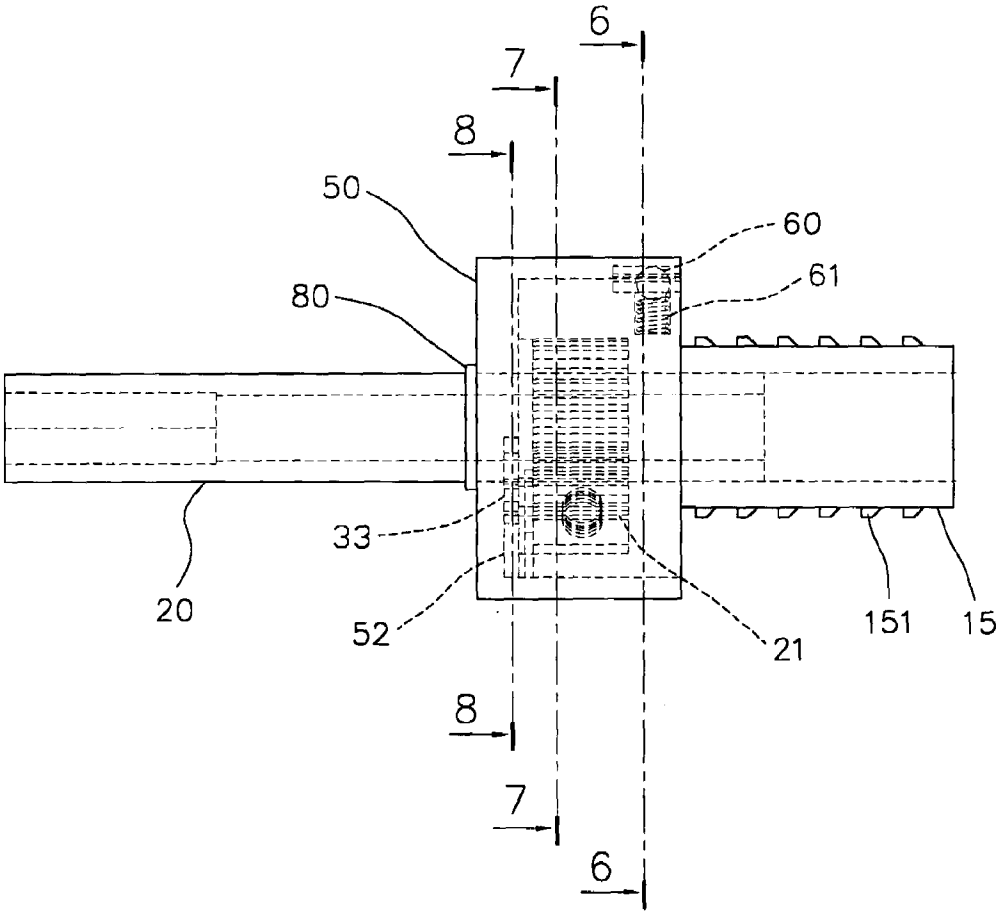
FIG. 5 is a plan view of the screwdriver as shown in FIG. 1.

Referring to the drawings and initially to FIGS. 1–8, a screwdriver in accordance with the preferred embodiment of the present invention comprises a body 10, a ratchet wheel 20, two pawl members 30, two elastic members 40, a cover 50, a catch plate 70, and a snap ring 80.

The body 10 has a first end formed with a receiving hole 11 and a plurality of (preferably two) radially and symmetrically arranged receiving recesses 12 each communicating with the receiving hole 11 and a second end 15 formed with a channel 16 communicating with the receiving hole 11. Each of the receiving recesses 12 of the body 10 has two parallel sides 121. The second end 15 of the body 10 has a periphery formed with a plurality of protruding fixing blocks 151.

The ratchet wheel 20 is mounted on the body 10 and has an outer wall formed with an annular toothed portion 21 mounted in the receiving hole 11 of the body 10. The ratchet wheel 20 has a first end formed with a polygonal recess 24 and a second end formed with an elongated slot 23 communicating with the polygonal recess 24.

Each of the pawl members 30 is mounted in a respective one of the receiving recesses 12 of the body 10 and has two parallel sides 32. Each of the pawl members 30 has a first face formed with a toothed portion 31 engaged with the toothed portion 21 of the ratchet wheel 20 and a second face formed with a locking portion 34. Each of the pawl members 30 has an end formed with a driven block 33.

Each of the elastic members 40 is mounted on the locking portion 34 of a respective one of the pawl members 30 and is urged between a side face of a respective one of the receiving recesses 12 of the body 10 and a respective one of the pawl members 30.

The cover 50 is rotatably mounted on the body 10. The body 10 has a periphery formed with a radially arranged receiving bore 14 for receiving an elastic member 61 and a positioning ball 60 which is urged on an inner wall of the cover 50. The inner wall of the cover 50 is formed with a plurality of (preferably three) positioning recesses 54, and the positioning ball 60 of the body 10 is detachably positioned in either one of the positioning recesses 54 of the cover 50. The cover 50 has a closed end formed with a through hole 51, and the first end of the ratchet wheel 20 is extended through and protruded from the through hole 51 of the cover 50. The closed end of the cover 50 is formed with a depression 52 formed with a protruding urging block 53 having two urging sides 531 each of which is movable with the cover 50 to press the driven block 33 of a respective one of the pawl members 30.

The first end of the body 10 is formed with a positioning slit 13 located in front of the receiving hole 11 and the receiving recesses 12. The catch plate 70 is mounted in the positioning slit 13 of the body 10 to catch the ratchet wheel 20 and the pawl members 30, thereby preventing the ratchet wheel 20, the pawl members 30 and the elastic members 40 from detaching from the body 10.

The snap ring 80 is mounted on the ratchet wheel 20 and rested on the cover 50 to retain the cover 50 on the body 10. Preferably, the outer wall of the ratchet wheel 20 is formed with an annular groove 22 located beside the toothed portion 21, and the snap ring 80 is secured in the annular groove 22 of the ratchet wheel 20.

Figure 6:
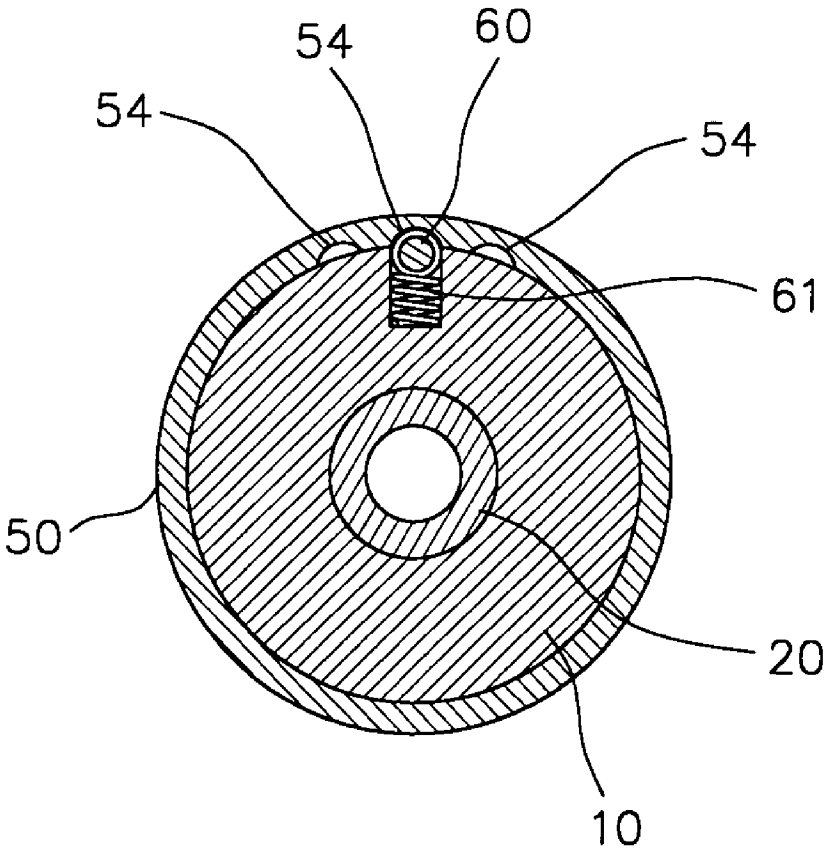
FIG. 6 is a plan cross-sectional view of the screwdriver taken along line 6—6 as shown in FIG. 5.
Figure 7:
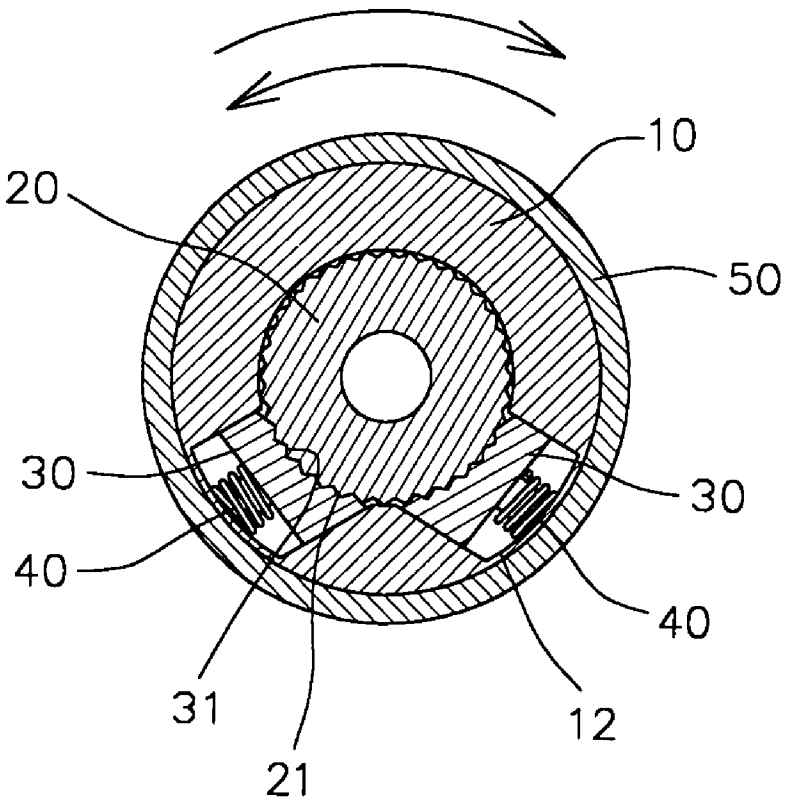
FIG. 7 is a plan cross-sectional view of the screwdriver taken along line 7—7 as shown in FIG. 5.
Figure 8:
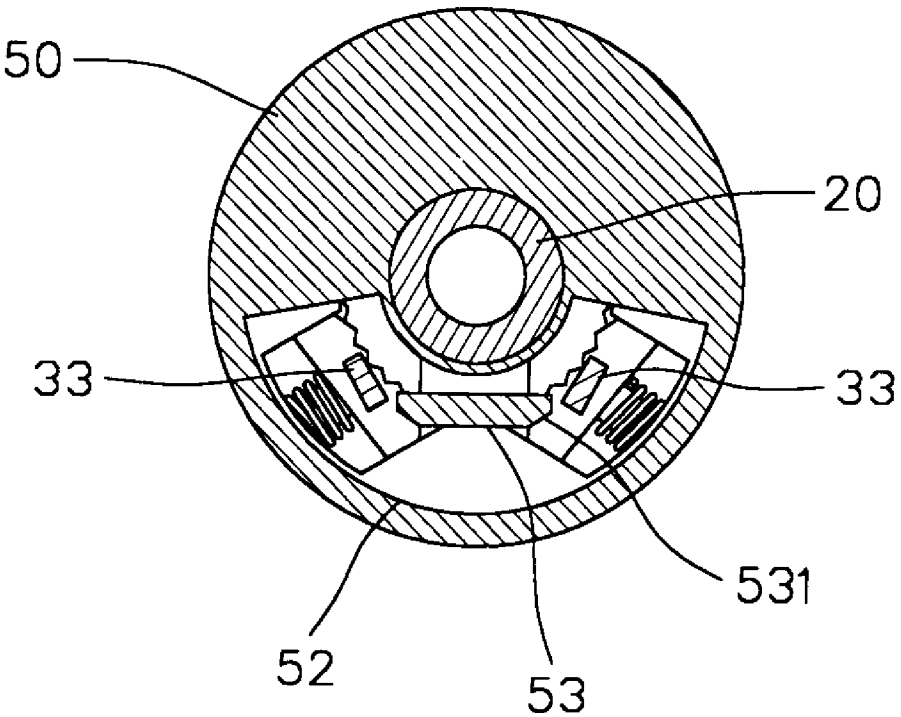
FIG. 8 is a plan cross-sectional view of the screwdriver taken along line 8—8 as shown in FIG. 5.

In operation, referring to FIGS. 6–8 with reference to FIGS. 1–5, when the cover 50 is rotated on the body 10 to a position as shown in FIG. 6 where the positioning ball 60 of the body 10 is positioned in a middle one of the positioning recesses 54 of the cover 50, each of the urging sides 531 of the urging block 53 of the cover 50 is detached from the driven block 33 of a respective one of the pawl members 30 as shown in FIG. 8, so that the toothed portion 31 of each of the pawl members 30 is engaged with the toothed portion 21 of the ratchet wheel 20 as shown in FIG. 7.

In such a manner, when the body 10 is rotated clockwise or counterclockwise, both of the pawl members 30 are driven by the body 10 to drive the ratchet wheel 20 to rotate clockwise or counterclockwise, so that the screwdriver functions as a common dual-directional screwdriver.

Figure 9:
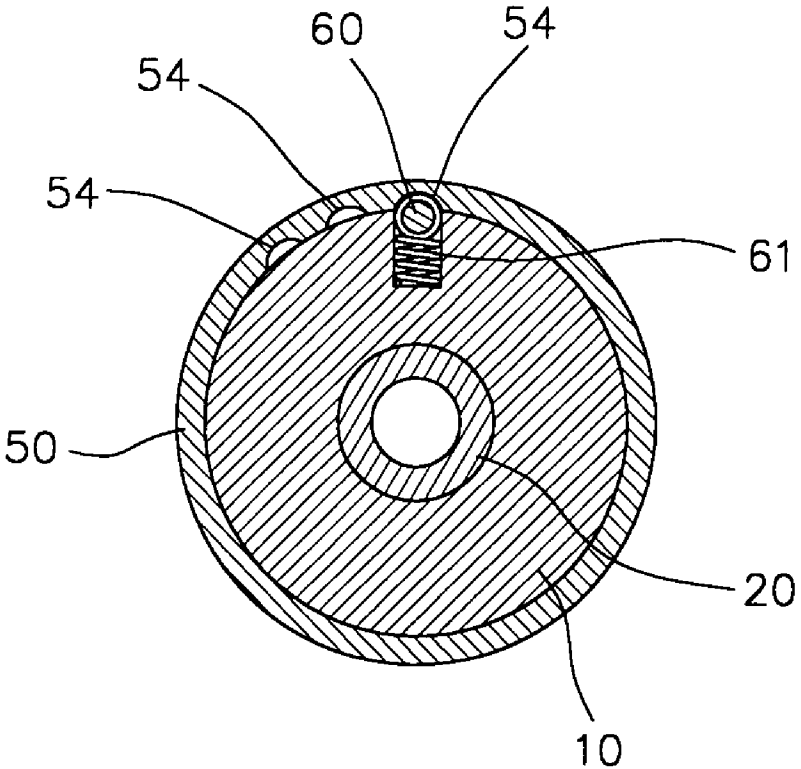
FIG. 9 is a schematic operational view of the screwdriver as shown in FIG. 6.
Figure 10:
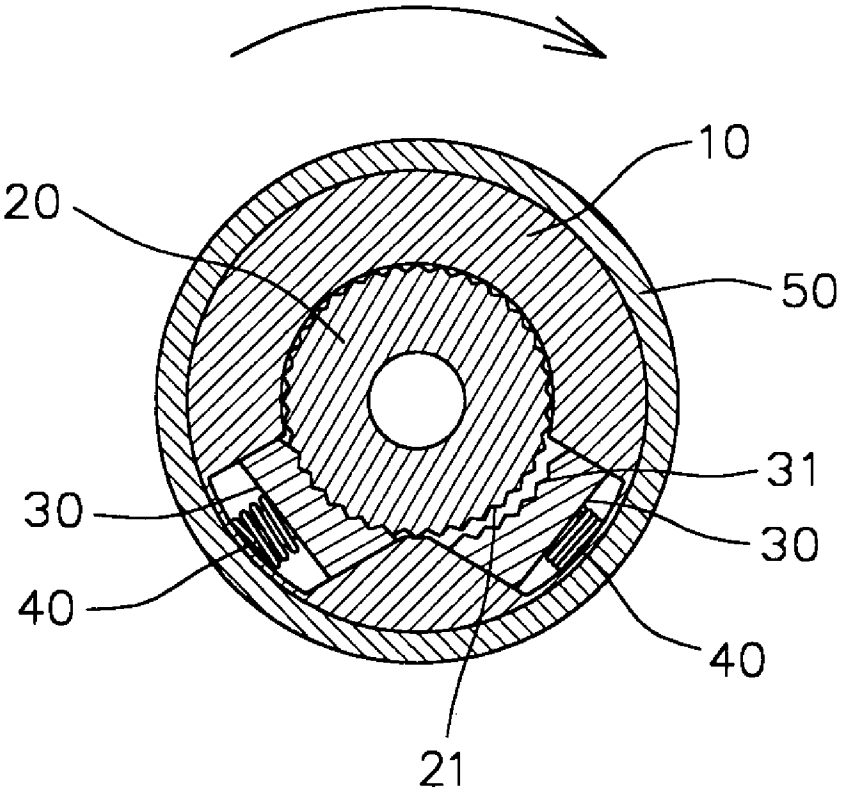
FIG. 10 is a schematic operational view of the screwdriver as shown in FIG. 7.
Figure 11:
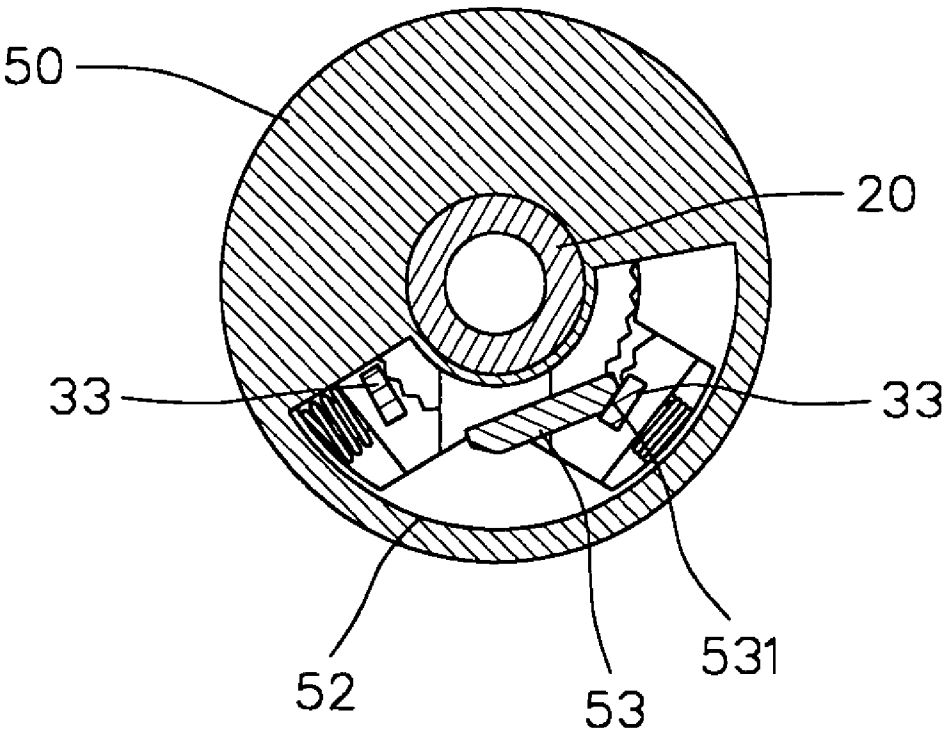
FIG. 11 is a schematic operational view of the screwdriver as shown in FIG. 8.

Alternatively, referring to FIGS. 9–11 with reference to FIGS. 1–5, when the cover 50 is rotated on the body 10 to a position as shown in FIG. 9 where the positioning ball 60 of the body 10 is positioned in a rightward one of the positioning recesses 54 of the cover 50, a rightward one of the urging sides 531 of the urging block 53 of the cover 50 is urged on the driven block 33 of a respective one of the pawl members 30 as shown in FIG. 11, so that the toothed portion 31 of a rightward one of the pawl members 30 is detached from the toothed portion 21 of the ratchet wheel 20 as shown in FIG. 10.

In such a manner, when the body 10 is rotated clockwise, a leftward one of the pawl members 30 is driven by the body 10 to drive the ratchet wheel 20 to rotate clockwise, and when the body 10 is rotated counterclockwise, the rightward one of the pawl members 30 slips from the ratchet wheel 20, so that the body 10 idles in the counterclockwise direction. Thus, the screwdriver functions as a ratchet type one-way screwdriver.

Accordingly, the cover 50 can be removed from the body 10 as shown in FIG. 1, so that the user can inspect and adjust connection between the pawl members 30 and the ratchet wheel 20, thereby facilitating the user repairing the screwdriver. In addition, the catch plate 70 stops movement of the ratchet wheel 20 and the pawl members 30, thereby preventing the ratchet wheel 20, the pawl members 30 and the elastic members 40 from detaching from the body 10 after the cover 50 is removed from the body 10.

Figure 12:
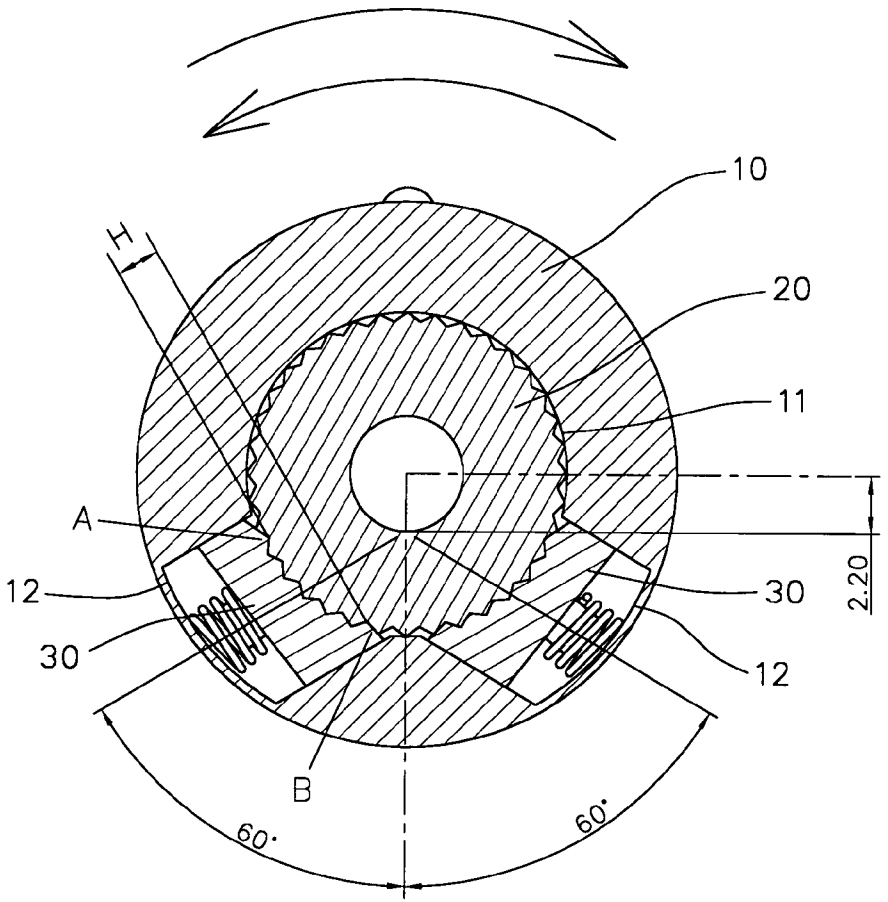
FIG. 12 is an enlarged view of the screwdriver as shown in FIG. 7.
Figure 19:
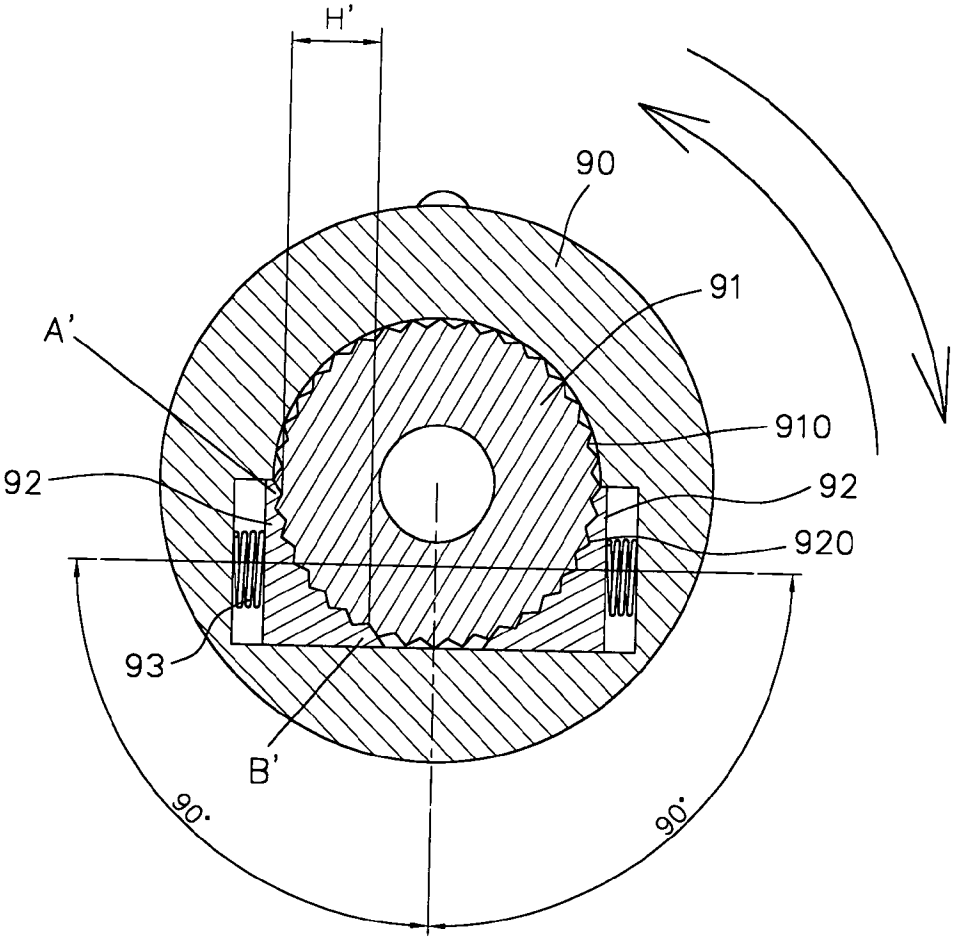
FIG.19 PRIOR ART
FIG. 19 is a plan cross-sectional view of a conventional screwdriver in accordance with the prior art.

Referring to FIG. 12, the receiving recesses 12 of the body 10 are radially arranged with an included angle of 120 degrees and have central lines intersecting at a point which is distant from the center of the receiving hole 11 of the body 10 by 2.2 mm. Each of the pawl members 30 has a first side toothed portion A and a second side toothed portion B with a height differential H which is smaller than the height differential H' as shown in FIG. 19, so that the second side toothed portion B of each of the pawl members 30 has a greater thickness. Thus, each of the pawl members 30 can withstand a larger torque to drive the ratchet wheel 20 to rotate.

Figure 13:
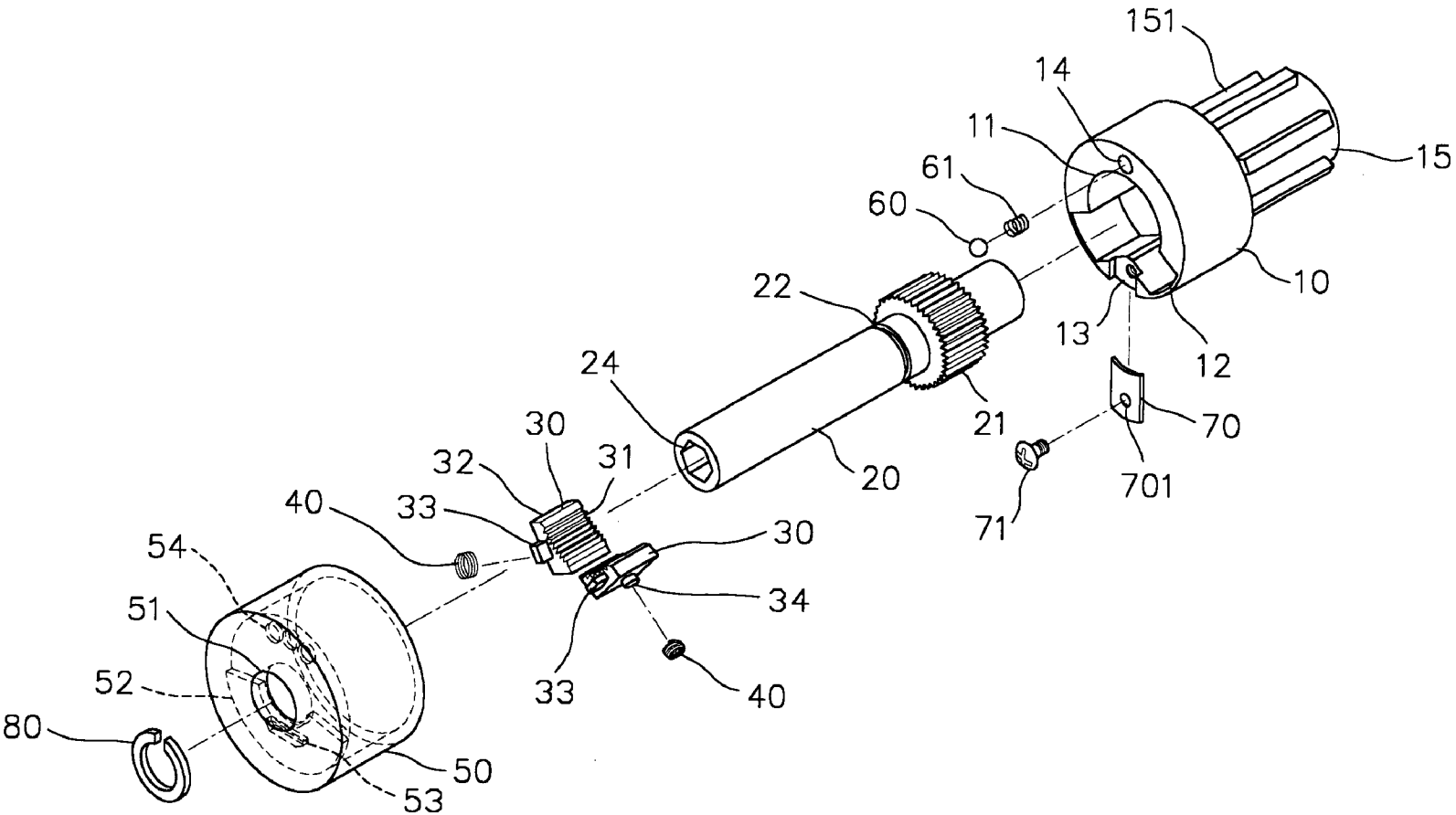
FIG. 13 is an exploded perspective view of a screwdriver in accordance with another embodiment of the present invention.
Figure 14:
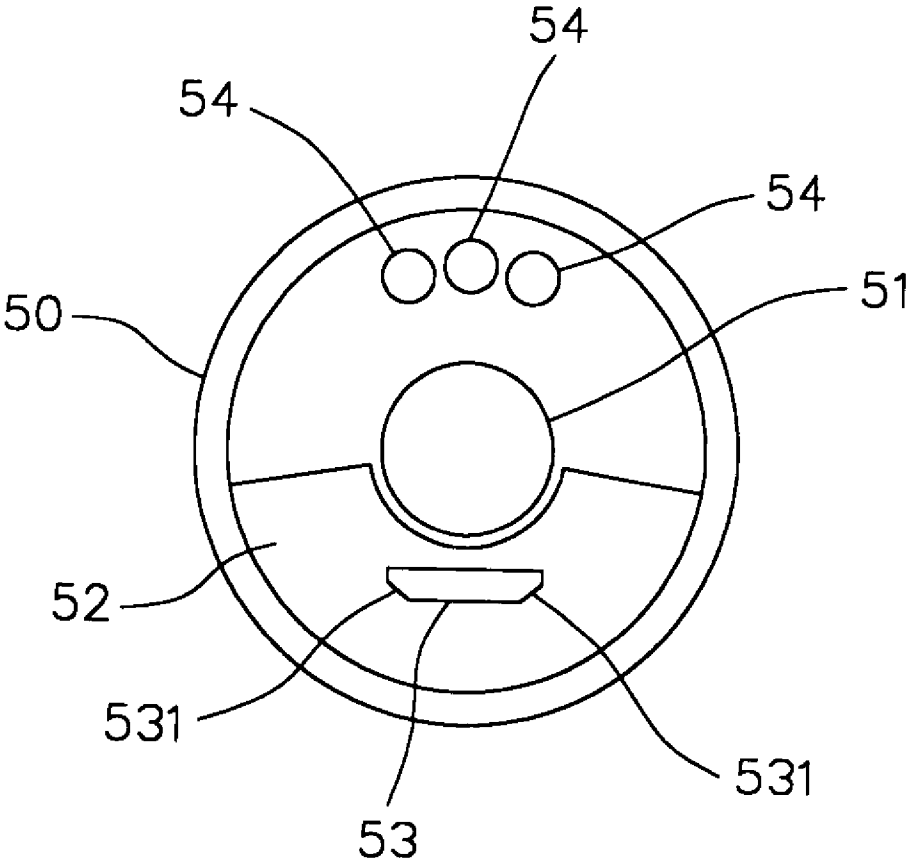
FIG. 14 is a plan view of a cover of the screwdriver as shown in FIG. 13.

Referring to FIGS. 13 and 14, the receiving bore 14 is formed in the first end of the body 10 and located beside the receiving hole 11 of the body 10, and the positioning recesses 54 are formed in the closed end of the cover 50. In addition, the positioning slit 13 of the body 10 has an opened shape, the catch plate 70 is formed with a through hole 701, and the screwdriver further comprises a screw member 71 extended through the through hole 701 of the catch plate 70 and screwed into the positioning slit 13 of the body 10.

Figure 15:
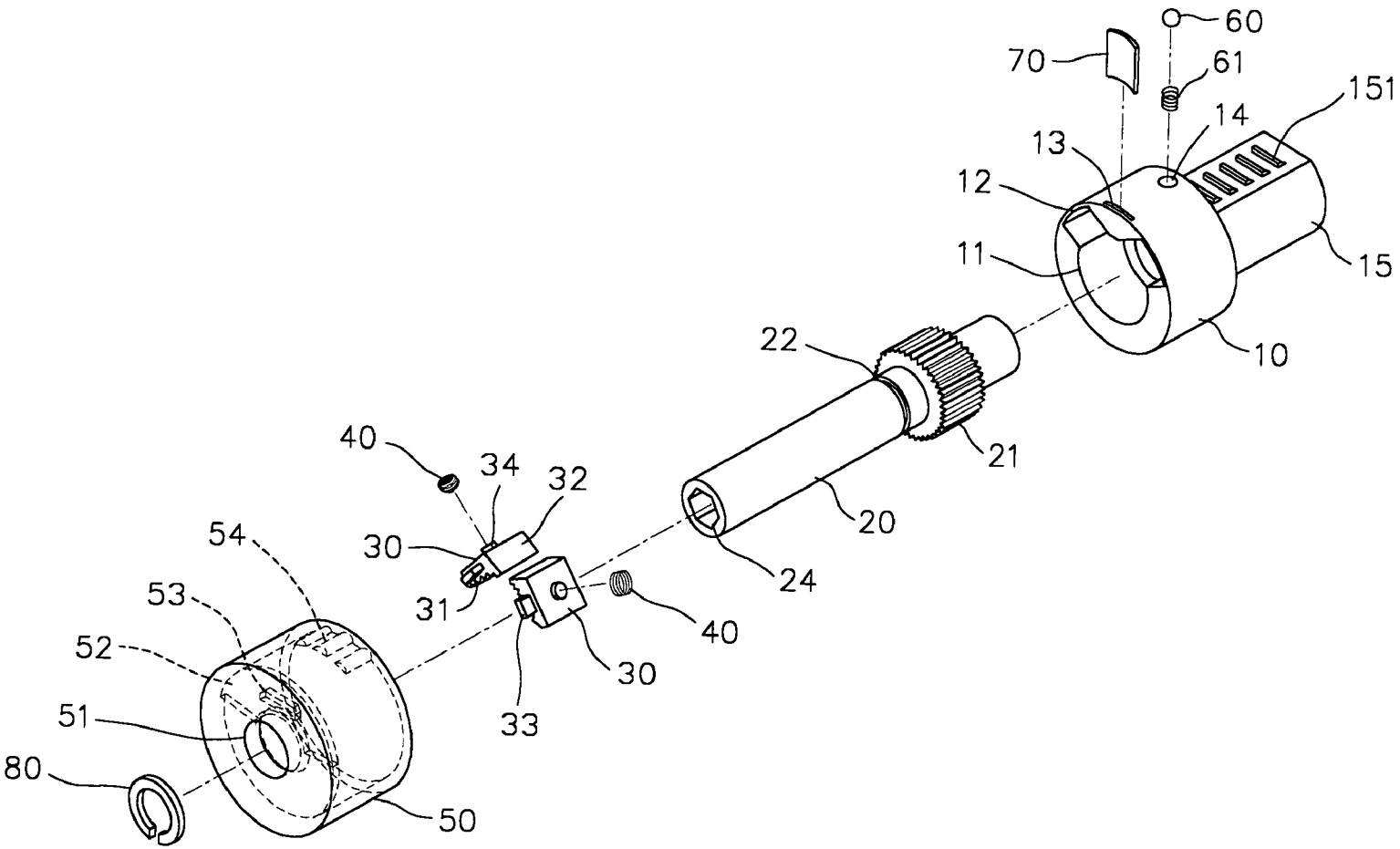
FIG. 15 is an exploded perspective view of a screwdriver in accordance with another embodiment of the present invention.
Figure 16:
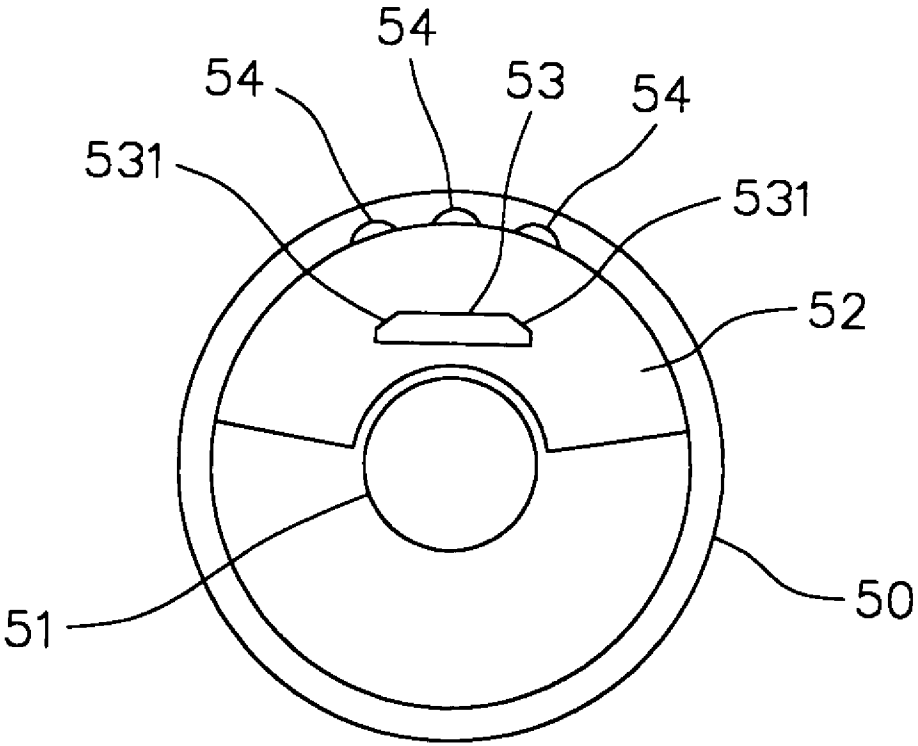
FIG. 16 is a plan view of a cover of the screwdriver as shown in FIG. 15.

Referring to FIGS. 15 and 16, the depression 52 and the urging block 53 of the cover 50 are located at different positions, and the receiving recesses 12 and the positioning slit 13 of the body 10 are located at different positions correspondingly.

Figure 17:
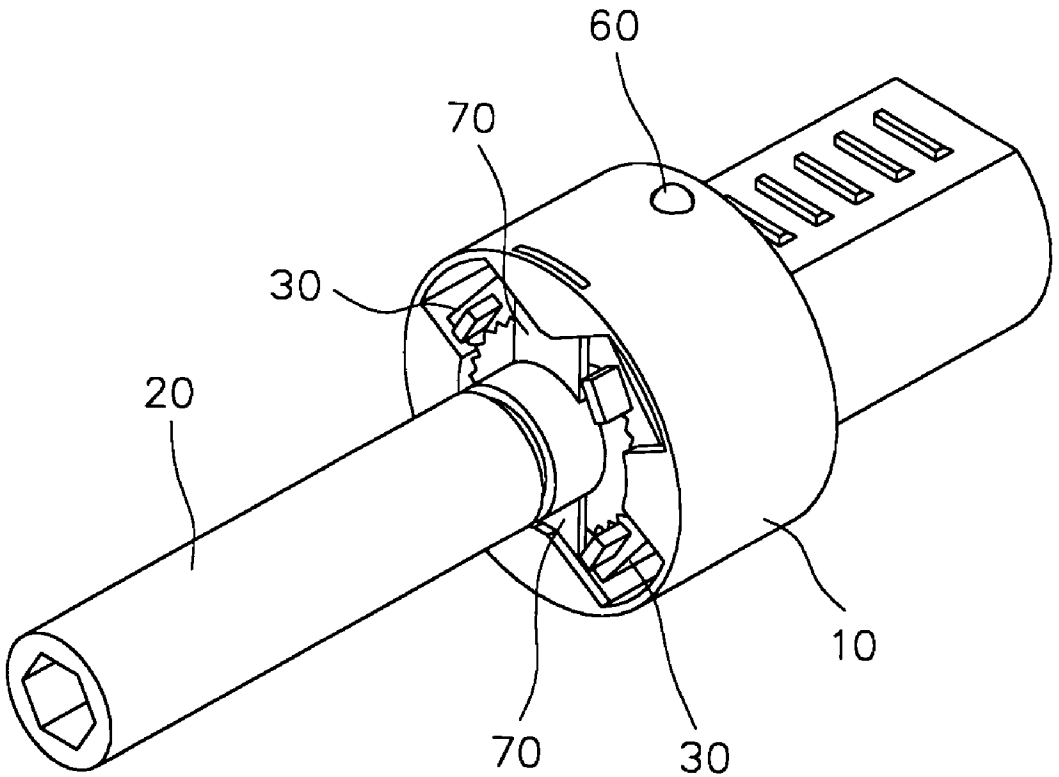
FIG. 17 is a perspective view of a screwdriver in accordance with another embodiment of the present invention.
Figure 18:
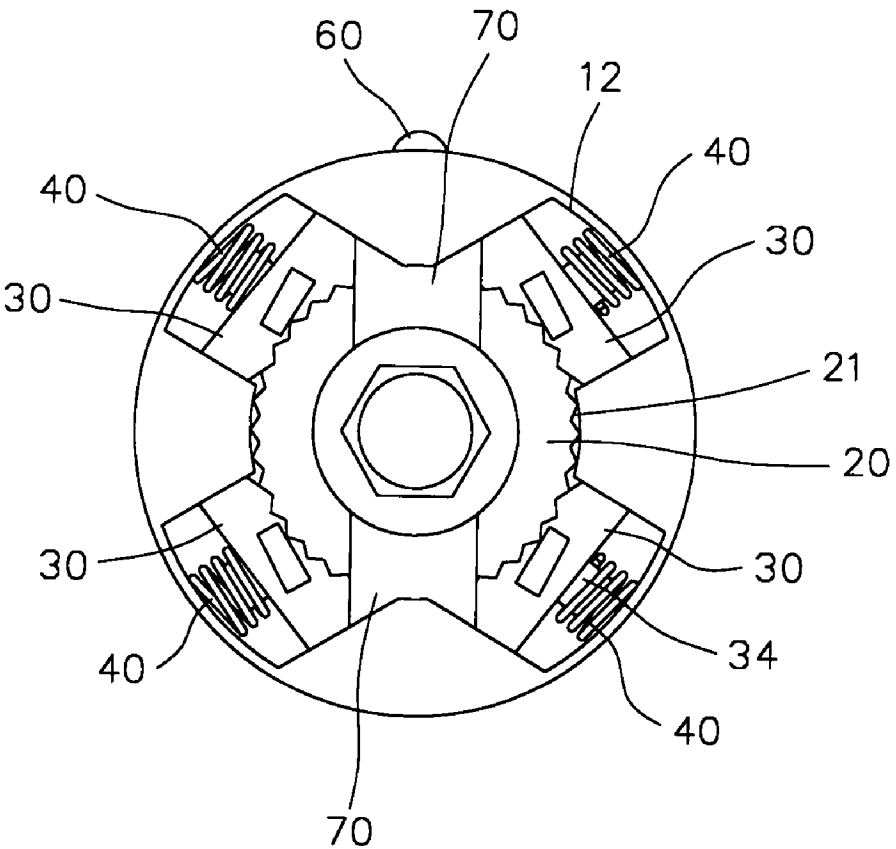
FIG. 18 is a plan view of the screwdriver as shown in FIG. 17.

Referring to FIGS. 17 and 18, the screwdriver comprises four pawl members 30 and four elastic members 40, and the body 10 has four radially and symmetrically arranged receiving recesses 12.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A screwdriver, comprising a body, a ratchet wheel, two pawl members, two elastic members, a cover, and a catch plate, wherein:

the body has a first end formed with a receiving hole, a plurality of receiving recesses communicating with the receiving hole and a positioning slit in communication with the receiving recesses;

the ratchet wheel is mounted on the body and has an outer wall formed with an annular toothed portion mounted in the receiving hole of the body;

each of the pawl members is mounted in a respective one of the receiving recesses and has a first face formed with a toothed portion engaged with the toothed portion of the ratchet wheel, each of the pawl members has an end formed with a driven block;

each of the elastic members is urged between a side face of a respective one of the receiving recesses of the body and a respective one of the pawl members;

the cover is rotatably mounted on the body and has a closed end formed with a depression formed with a protruding urging block having two urging sides each of which is movable with the cover to press the driven block of a respective one of the pawl members; and the catch plate comprising a portion fit in the positioning slit of the body, another portion located in the receiving hole and two other portions located in the receiving recesses to retain the toothed portion of the ratchet wheel, the pawl members and the elastic members in the body.

2. The screwdriver in accordance with claim 1, wherein the body has a second end formed with a channel communicating with the receiving hole.

3. The screwdriver in accordance with claim 2, wherein the second end of the body has a periphery formed with a plurality of protruding fixing blocks.

* * * * *